US012588733B2

(12) United States Patent
Thorpe

(10) Patent No.: US 12,588,733 B2
(45) Date of Patent: Mar. 31, 2026

(54) SYSTEM AND METHOD FOR THERMAL CONTROL IN SKI BOOTS

(71) Applicant: BOOT CAP LLC, Salt Lake City, UT (US)

(72) Inventor: Calvin Michael Thorpe, Salt Lake City, UT (US)

(73) Assignee: BOOT CAP LLC, Salt Lake City, UT (US)

( * ) Notice: Subject to any disclaimer, the term of this patent is extended or adjusted under 35 U.S.C. 154(b) by 12 days.

(21) Appl. No.: 17/793,407

(22) PCT Filed: Jan. 18, 2021

(86) PCT No.: PCT/US2021/013809
§ 371 (c)(1),
(2) Date: Jul. 17, 2022

(87) PCT Pub. No.: WO2021/146675
PCT Pub. Date: Jul. 22, 2021

(65) Prior Publication Data

US 2023/0053676 A1 Feb. 23, 2023

Related U.S. Application Data

(60) Provisional application No. 62/962,643, filed on Jan. 17, 2020.

(51) Int. Cl.
*A43B 5/18* (2006.01)
*A43B 3/20* (2022.01)
(Continued)

(52) U.S. Cl.
CPC ..... *A43B 5/18* (2013.01); *A43B 3/20* (2013.01); *A43B 5/0486* (2013.01); *A43B 7/12* (2013.01); *A43B 7/34* (2013.01)

(58) Field of Classification Search
CPC ..... A43B 5/18; A43B 5/0415; A43B 5/04; A43B 3/20; A43B 3/16; A43B 3/18; A43B 7/34
(Continued)

(56) References Cited

U.S. PATENT DOCUMENTS 2,836,908 A * 6/1958 Altinger ..... A43B 5/1683 280/811
3,974,578 A * 8/1976 Oettinger ..... A43B 5/18 36/72 R
(Continued)

FOREIGN PATENT DOCUMENTS

CA 207748 S 11/2021
KR 970005825 Y1 * 6/1997 ..... A43B 3/18

OTHER PUBLICATIONS

Camper SL, Camper "Junction" available at https://www.camper.com/en_US/content/junction (2023).

*Primary Examiner* — Aiying Zhao
(74) *Attorney, Agent, or Firm* — NorthStar Law Group

(57) ABSTRACT

Systems, methods and devices for limiting the transfer of thermal energy in ski boots and slowing thermal energy conduction through the ski boots are provided. Devices may have an upper shell and a side band and an attachment device for attaching the device to the toe box area of ski boot. The devices may further comprise materials that are intended to limit the transfer of thermal energy.

16 Claims, 14 Drawing Sheets

(51) Int. Cl.
*A43B 5/04* (2006.01)
*A43B 7/12* (2006.01)
*A43B 7/34* (2006.01)

(58) Field of Classification Search
USPC ..... 36/7.1 R, 7.2, 136, 117.1
See application file for complete search history.

(56) References Cited

U.S. PATENT DOCUMENTS

| | | | | | |
|---|---|---|---|---|---|
| 5,471,767 | A * | 12/1995 | Walker | A61F 7/03 | 36/2.6 |
| 5,893,220 | A * | 4/1999 | Miller | A43B 3/0078 | 36/7.1 R |
| 6,598,323 | B1 * | 7/2003 | Gougelet | A43B 23/086 | 36/77 R |
| 2003/0037462 | A1 * | 2/2003 | Tanaka | A43B 23/086 | 36/77 R |
| 2004/0049949 | A1 * | 3/2004 | Valentini | A43C 13/14 | 36/77 R |
| 2004/0250445 | A1 * | 12/2004 | Pritchett | A43B 3/16 | 36/2.6 |
| 2006/0196084 | A1 * | 9/2006 | Kos | A43B 1/0081 | 36/133 |
| 2012/0060389 | A1 * | 3/2012 | Mille | A43B 3/26 | 36/7.1 R |
| 2012/0317842 | A1 * | 12/2012 | McClelland | A43B 5/18 | 36/115 |
| 2017/0071282 | A1 * | 3/2017 | Fransko, Sr. | A43B 3/26 | |

* cited by examiner

SYSTEM AND METHOD FOR THERMAL CONTROL IN SKI BOOTS

CROSS-REFERENCE TO RELATED APPLICATION

This application claims priority from and the benefit of U.S. Provisional Application 62/962,643 filed 17 Jan. 2020 with the US Patent Office. The specification of the aforesaid provisional application is hereby incorporated by reference in its entirety.

TECHNICAL FIELD

This disclosure is particularly directed towards thermal control ski boots. Specifically, this invention is directed towards a system and method for thermal control of ski boots with respect to limiting thermal heat transfer.

BACKGROUND ART

Control of body temperature when outdoors has long been desired. Different methods have been introduced to better control temperature, the most obvious being clothing and footwear to protect or deflect heat around a person via that footwear. Such is true for ski boots and related clothing. However, often the available clothing and ski boots are insufficient.

Other methods of temperature control include inner thermal layers for better temperature control. Thicker socks, chemically-heated hosiery. electrically-heated hosiery and hosiery with exothermic chemical heat packs have been developed to help human feet stay within a desired temperature range. This can result in a bulky and/or uncomfortable situation, especially when the desired outdoor activity involves a lot of motion, such as ski boots. They also add weight to the ski boot, thus adding to fatigue and discomfort during use.

Furthermore, covers for ski boots have also been developed to help control temperature. These methods involve systems such as zippers or ties and must be partially or fully removed prior to removing or adjusting the ski boots. Such methods and systems cover a bulk of the ski boot to provide warmth to the entirety of the ski boot. Such methods and systems are bulky or cumbersome and are difficult to use due to their inability to adjust ski boots once on. Such systems are also heavier as they involve covering the majority or totality of the ski boot in order to better insulate the ski boot from the outside temperature. Some systems further absorb water, thus becoming heavier during use.

It has therefore been a long-felt need to find a way to limit the transfer of thermal energy in ski boots and to provide a buffer to the outside elements without the need to adjust or remove the temperature control device in order to adjust or remove the ski boots while also not sacrificing the often needed durability, water resistance, lightness, and other beneficial features of said ski boots.

SUMMARY OF THE INVENTION

A system for limiting transfer of thermal energy of ski boots and slowing the conduction of that thermal energy through the ski boots is described. The ski boots having a toe box portion, a toe end, a sole, and a vamp portion, the device includes an upper shell configured to cover a top section of the toe box portion of the ski boots, a side band integrally connected to the upper shell and further configured to cover a majority of a set of side sections of the toe box portion of the ski boots, wherein the device includes a material that limits the transfer of thermal energy and slows conduction through the shell of the ski boot.

DESCRIPTION OF EMBODIMENTS

Figure 1:
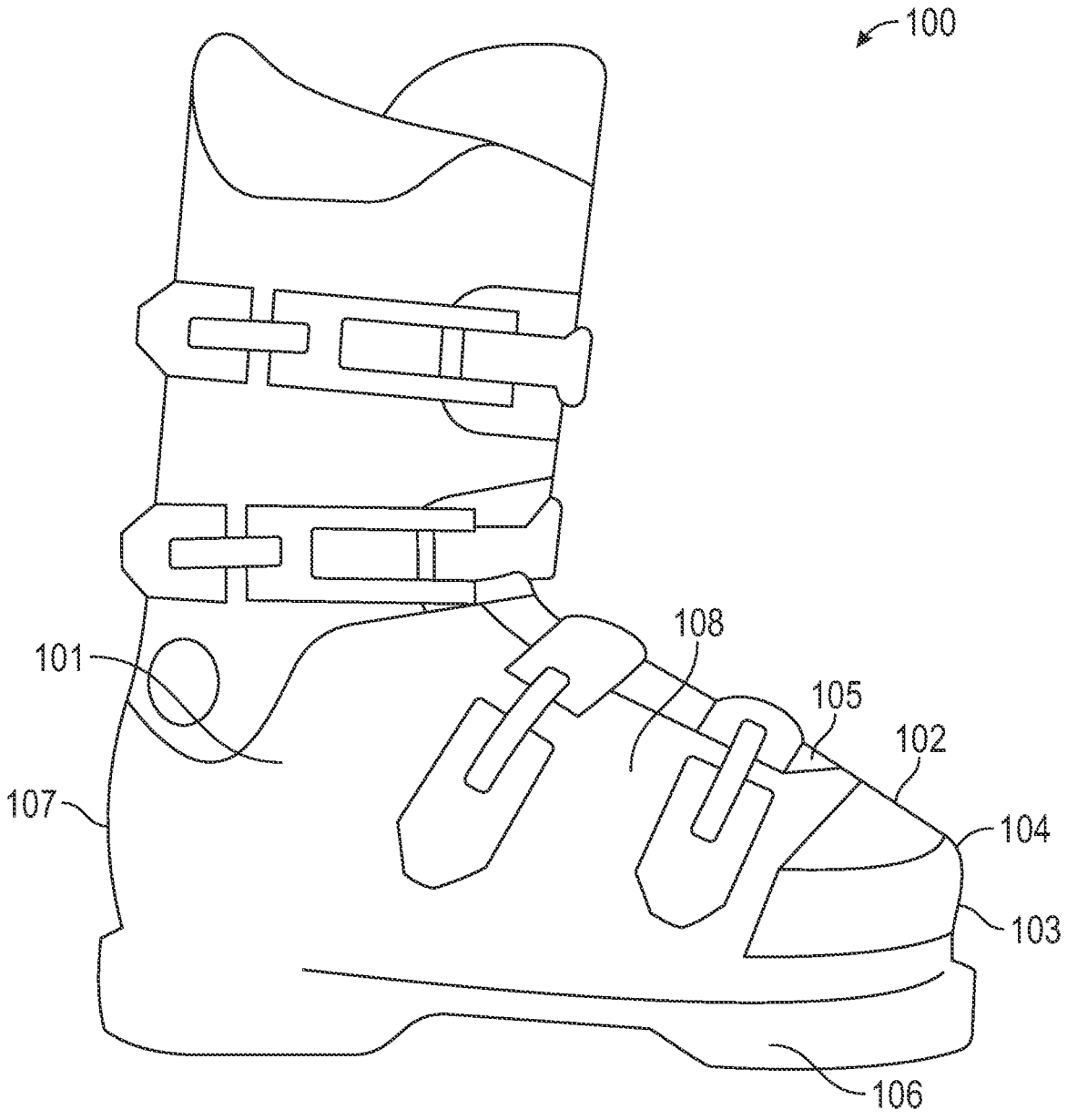
FIG. 1 depicts an item of available ski boot with the system attached according to embodiments represented herein.

Described herein are systems and methods for limiting the transfer of thermal energy of ski boots and slowing conduction through the ski boots. They include systems and methods that improve the ability to limit the transfer of thermal energy in ski boots without limiting the ability to adjust, remove, or put on said ski boots. The systems and methods described herein are highly desirable and meet a long felt need as they reduce the loss of thermal energy in ski boots without inhibiting or limiting the adjustment, removal or the ability to don the ski boots. The systems and methods described herein further act as a buffer to the outside elements, especially the typical cold conditions in which ski boots are used, slowing the conduction through the shell of the ski boot, thus keeping the toes and feet warmer for a longer period of time.

Embodiments described herein are lightweight, including being comprised of materials which consist of foam structures. Some embodiments further include the benefits of not absorbing water, thus further limiting the added weight to the ski boot when the systems and methods disclosed herein are utilized. Such may be especially useful for ski boots, as being lightweight is a much demanded feature.

The systems and methods herein solve the problems of the art in an unexpected way. Prior systems covered the majority, even near totality of a ski boot in order to achieve an effective limit on the transfer of thermal energy out of said ski boot. The systems and methods described herein limit the transfer of thermal energy in the extremities of said ski boots, specifically the toe box without covering a majority of said ski boot. This is further beneficial as it is usually the extremities, namely the toes in the toe box portion of ski boots that users of that footwear are concerned with. Thus, the systems and methods described herein are able to do what others could not with a much smaller impact on the user than is previously known in the art.

For the purposes of promoting an understanding of the principles in accordance with this disclosure, reference will now be made to the embodiments described herein and specific language will be used to describe the same. It will nevertheless be understood that no limitation of the scope of the disclosure is thereby intended. Any alterations and further modifications of the inventive features illustrated herein, and any additional applications of the principles of the disclosure as illustrated herein, which would normally occur to one skilled in the relevant art and having possession of this disclosure, are to be considered within the scope of the disclosure claimed.

Before the present system is disclosed and described, it is to be understood that this disclosure is not limited to the particular configurations, process steps, and materials disclosed herein as such configurations, process steps, and materials may vary somewhat. It is also to be understood that the terminology employed herein is used for the purpose of describing particular embodiments only and is not intended to be limiting since the scope of the present disclosure will be limited only by the appended claims and equivalents thereof.

It must be noted that, as used in this specification and the appended claims, the singular forms "a," "an," and "the" include plural referents unless the context clearly dictates otherwise.

In describing and claiming the present disclosure, the following terminology will be used in accordance with the definitions set out below.

As used herein, the terms "comprising," "including," "containing," "characterized by," and grammatical equivalents thereof are inclusive or open-ended terms that do not exclude additional, un-recited elements or method steps.

As used herein, the phrase "consisting of" and grammatical equivalents thereof exclude any element, step, or ingredient not specified in the claim.

As used herein, the phrase "consisting essentially of" and grammatical equivalents thereof limit the scope of a claim to the specified materials or steps and those that do not materially affect the basic and novel characteristic or characteristics of the claimed disclosure.

All measurements referred to herein shall be considered to include the ranges distributed around the provided measurement including ranges from 1-2 values around the measurement, 2-3 values around the measurement, 1-3 values around the measurement as well as all the values within. Thus, if the measurement is 10, this may include the values 7 and 13 and all the values between those.

Temperatures, temperature changes, temperature gradients, and other temperature measurements are listed in degrees Fahrenheit, unless otherwise noted.

This disclosure describes a device for limiting the transfer of thermal energy in ski boots and slowing conduction through the ski boots. As shown in FIG. 1, which represents an illustrative ski boot with an embodiment of the device attached. Said ski boot 100 may have a toe box portion 102, a toe end 104, a sole 106, and a vamp portion 108. The device 103, may be attached to the ski boot 100.

Figure 6:
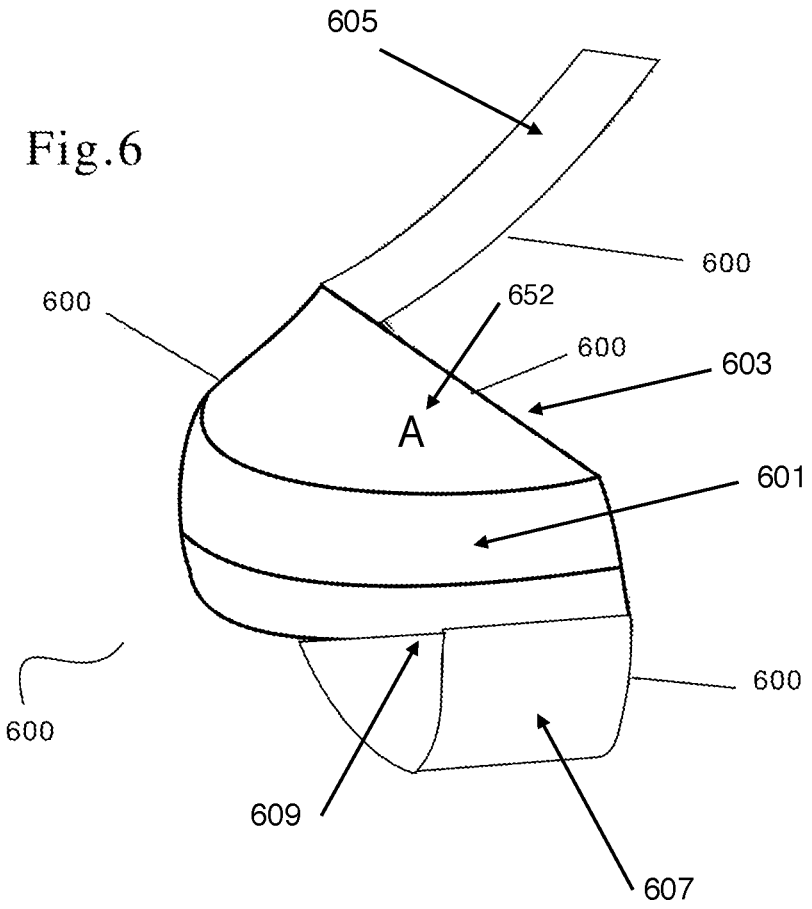
FIG. 6 depicts a device with attachment devices for limiting transfer of thermal energy in ski boots according to embodiments described herein.

The device in the present disclosure described wherein may comprise an upper shell, a side band and may be comprised of a material that limits the transfer of thermal energy. The device may further comprise a means for attaching configured to connectively attach the device to the toe box portion 102 of the ski boot 100. This may be done by means of adhesive, elastic, hook and loop, lace, or other means, including means that goes underneath the sole 106 of the ski boot in order to connectively attach the device to the toe box portion 102 of the ski boot 100. The means for attaching will be described in more detail below, and select embodiments of the means for attaching are shown in FIG. 6.

It will be understood that the embodiments of the present disclosure have particular benefits when used with ski boots of different kinds and configurations.

Again referring to FIG. 1, as used herein, the term toe box portion 102 means the portion of ski boot in the front upper, front side, and front bottom portions of the ski boot, all portions comprising the outer, exposed portion of the ski boot. The term toe end 104 delineates the upper line around the upper front end of the toe portion of the ski boot. The vamp 106 is the portion of the ski boot that comprises the middle upper and side portions of the ski boot and is next to the toe portion. The sole 106 is the bottom portion of the ski boot, that is intended to protect a foot from the ground. It will be understood that the particular configuration of ski boot will change but all ski boots which will benefit from the embodiments of the present disclosure will include such structures.

Generally speaking, some embodiments of the device as described herein may be configured to attach to the outside of ski boots and do not effect the size of the inside of the ski boot, as the device attaches to the outside and not the inside of the toe box portion of the ski boot. As used herein, the toe box portion and other references to parts of ski boot reference this outside surface of the ski boot unless otherwise noted.

Figure 2:
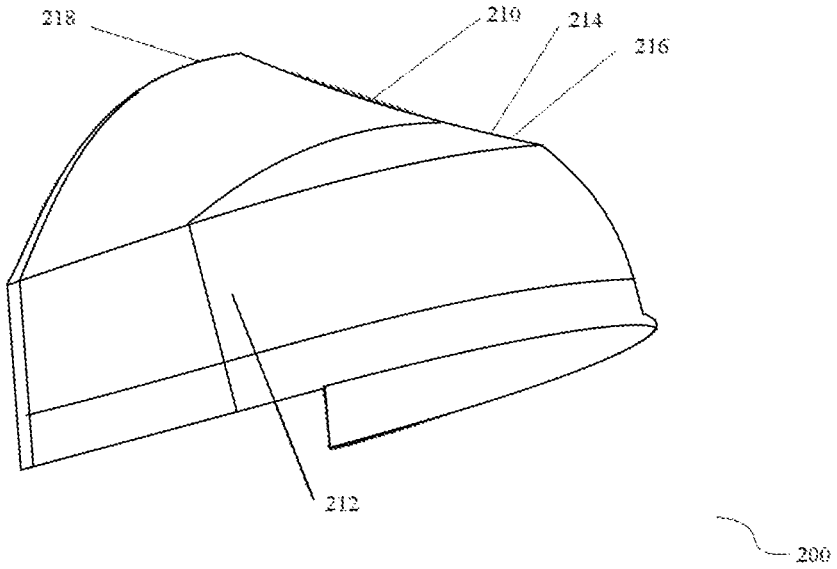
FIG. 2 depicts a system for limiting transfer of thermal energy in ski boots according to embodiments described herein.

Turning to FIG. 2, an embodiment or device of the present disclosure is depicted, generally at 200. The device 200 beneficially limits transfer of thermal energy of ski boots, the ski boot having a toe box portion, a toe end, a sole and a vamp portion. The device 200 may comprise an upper shell 210 configured to cover a top section of the toe box portion of the ski boot, a side band 212 integrally connected to the upper shell 210 and further configured to cover a majority of a set of the side sections of the toe box portion of the ski boot. The device 200 may be comprised of a material that limits the transfer of thermal energy. The device 200 may further comprise an attachment device configured to connectively attach the device to the ski boot. It is to be understood that the use of the term shell does not indicate any particular firmness or stiffness of the materials forming the shell, as explained below.

In some embodiments, the device 200 may be comprised of foam. In some embodiments, the foam may be open celled foam, expanded polystyrene, closed cell foam, neoprene, or other equivalent material or materials for limiting the transfer of thermal energy. In some embodiments, it may be preferable to use closed cell ethylene-vinyl acetate copolymer, known in the art as closed cell EVA foam, but materials such as natural rubber, vinyl, neoprene, polyurethane and PVC foams and similar materials might also be used. It may be even more preferred to use a foam with a density of about two pounds per cubic foot cross linked polyethylene lower density closed cell EVA foam. Other densities, such as between about 1 and about 5 pounds per cubic foot may be used in embodiments disclosed herein.

In some embodiments it may be beneficial to have the thermal resistance R value of between about 3 and about 7, but materials having other R values may be used in accordance with the principles disclosed herein. Generally, higher R values indicate more thermal resistance. In some embodiments, for example when a greater thermal resistance is preferred, a higher R value is preferred. In some example embodiments, the R value may range between 1 and 14, depending on the material used for the systems described herein, the desired thickness of the system, and the expense. In some embodiments, it may be preferred to have an R value between 5 and 7. Such may be preferred as desirable compromise between width of the system and cost of materials to build the system. Industry standard practices ASTM C 518 and ASTM C 1303 are appropriate method for determining the R value as disclosed herein, and such standard is incorporated herein by this reference.

The thickness of the materials from which device 200 is fabricated may range between about 0.1 millimeters and about 10 millimeters. The resulting thickness of the device may vary along different portions of the device, as described further below.

In some embodiments of this disclosure, a lower edge 214 of the upper shell 210 and an upper edge 216 of the side band may form a curve that roughly conforms to the curve of the toe end of the ski boot. In some embodiments, the device may be curved to roughly follow the curve of the toe box portion of the ski boot's upper and side portions.

The device 200 may be configured to not interfere with the fastening systems of the ski boot. These fastening systems may include those to hold the ski boot to a foot, including laces, buckles, hook and loop tape, lugs, and/or some other fastening system. They may further include fastening systems to insert the ski boot into other apparatuses such as skis, snow boards, or other equivalent mechanisms that ski boots may be inserted onto or into.

Returning to FIG. 1, a ski boot may optionally further include an upper 101, a throat 105, and a heel 107. In some embodiments, the device 200 for limiting transfer of thermal energy of ski boots may comprise an upper shell 210 configured to cover a top section of the toe box portion 102 of the ski boot. The top section of the toe box portion 102 may include an area that covers a majority of a top section of the toe box portion 102 of the ski boot spanning lengthwise from lower edge of the vamp 108 portion of the ski boot to the upper edge of the toc end 104 of the ski boot and across the width of the toe box portion of the ski boot. The device 200 may further include a side band 212 integrally connected to the upper shell 210 and further configured to cover a majority of a set of side sections of the toe box portion 102 of the ski boot, said set of side sections extending from the top of the side of the toe box to the sole 106 and extending from the center of the toe end 104 along both sides of the toe box 102. Thus, the upper shell 210 and the side band 212 of the device 200 are configured to cover a majority of the toe box 102 portion of the ski boot 100. The device 200 may further have at least one attachment means (not depicted in FIG. 2) configured to connectively attach the device 200 to the ski boot 100. The device 200 may be comprised of material that limits the transfer of thermal energy.

Figure 3:
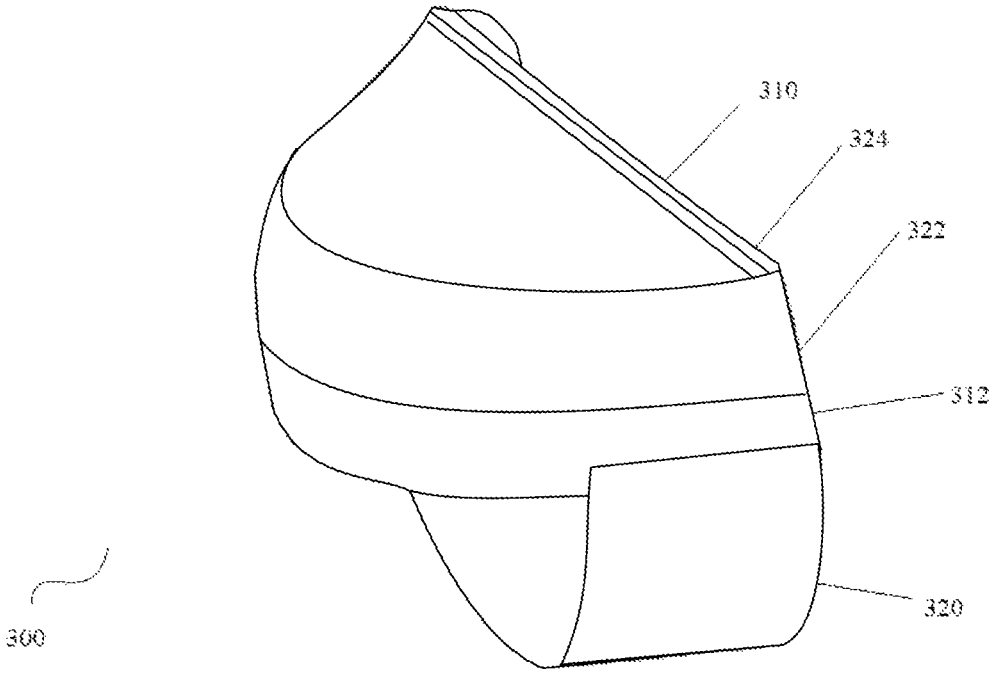
FIG. 3 depicts a system for limiting transfer of thermal energy in ski boots including an attachment device according to embodiments described herein.

As shown in FIG. 3, another embodiment in accordance with the present disclosure is a device 300 which may comprise an attachment means 320. Attachment means 320 is a non-limiting example of attachment means for the systems and methods described herein. In some embodiments, the attachment means 320 may comprise at least one elastic band. In some embodiments, not explicitly represented in FIG. 3, the attachment means may comprise a hook and loop tape, glue, double stick tape or other securing structure. In some embodiments, not explicitly represented in FIG. 3, the attachment means may be configured to adhere an underside of the upper shell of the device to an outer section of the toe box portion of the ski boot.

As embodied in FIG. 3, the attachment means 320 may further comprise a strap attached to each side of the bottom edge of the side band of the device and may be configured to slide under the sole of the ski boot. In some embodiments, attachment means 320 may be configured such that it is configured to go under the sole of the ski boot at a position where the sole meets a proximal portion of the toe box 102. In some embodiments, attachment means 320 may be configured to go under the sole of the ski boot at a position on the sole that connects to the vamp portion of the ski boot. The attachment means 320 may be configured to attach the device 300 to the ski boot, while also not interfering with any ski boot connecting systems. Such ski boot connecting systems may include a removable toe lug and boot system or other binding system connecting ski boots to another device for movement. Thus, the attachment means 320 may be configured to not interfere with a boot binding interface or related ski boot connecting system on the ski boot when the device 300 is positioned on the ski boot.

In some embodiments, the device 300 may comprise an attachment means (not explicitly depicted in FIG. 3) that is configured to be adhered to the underside of the device and to the top section of the toe box portion of the ski boot. Some embodiments of the device may comprise an attachment means that comprises more than one strap, adhesive or other means as described herein. For example, some embodiments may include attachment means comprising a strap that is configured to go under the sole of the ski boot and comprising an adhesive that is configured to attach a portion of the underside of the upper shell to the toe box of the ski boot.

Some embodiments of the device may have an attachment means that comprises a strip attached to a front under side of the upper shell of the device and may be configured to secure the device to the ski boot by being configured to be placed along the throat 105 of the ski boot. An embodiment of such a strip is shown as strip 605 in FIG. 6. In some embodiments, the strip may be configured to be placed under at least one buckle or lace of the ski boot. This configuration may allow the buckles or laces of the ski boot to perform their attachment and detachment functions while the device is attached to the ski boot without the need to remove the device. Such buckles, laces and fastening systems include, but are not limited to those that are depicted in footwear as described in U.S. Pat. Nos. 4,265,034, 3,729,779, 3,163,900, 6,226,898 and European Patent No. 2,591,696, which are incorporated herein by this reference.

Referring again to FIG. 3, in some embodiments, the attachment structure may be located on the underside of the upper shell 310. In some embodiments, the attachment structure 320 may be located on the bottom side of the side band 312. In some embodiments, more than one attachment device may be used. In some embodiments, the attachment device may be configured to allow the device to be separably attached to the ski boot. In some embodiments, the attachment structure may be configured to secure the device in a more permanent way. Glue, tape, double sided tape, elastic, hook and loop tape, a strip as disclosed herein, or other equivalent methods of attachment may be used as the attachment structure in some embodiments. In some embodiments, multiple types of attachment structure may be utilized.

Figure 4:
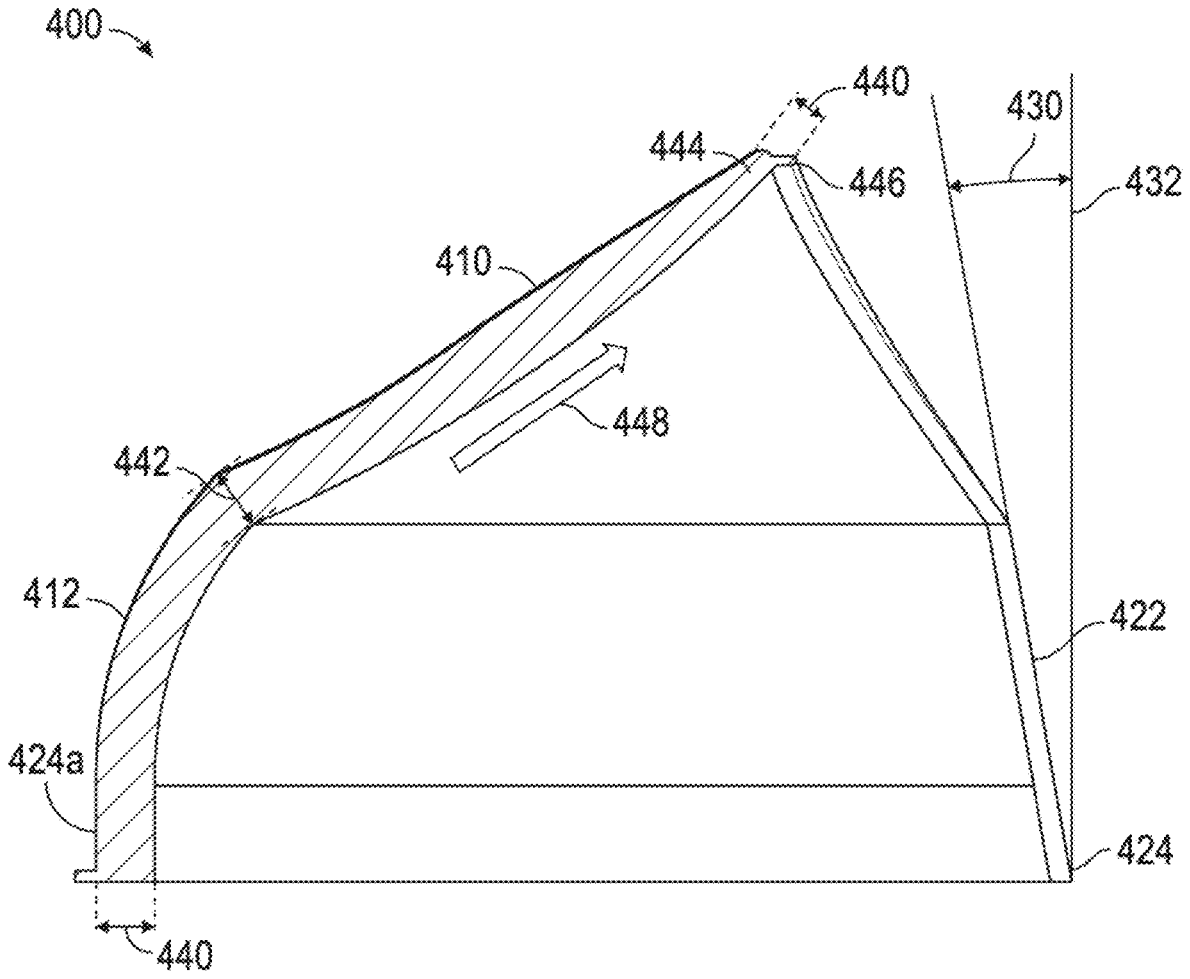
FIG. 4 depicts a cross sectional view of the system for limiting transfer of thermal energy in ski boots according to embodiments described herein.

Still referring to FIG. 3, the device 300 may be configured such that a proximal surface 322 of the side band 312 ends at an angle between about 5 and about 15 degrees from a line 432 perpendicular with a bottom edge 324 of the side band 312. The bottom edge 324 of the side band 312 may be configured to be parallel with the sole of the ski boot. In some embodiments, the angle may be as far as between 0 and 45 degrees. The angle may also be embodied to go away from the perpendicular line, such that an embodiment may have an angle between 0 and negative 45 degrees. It may be preferred to have an angle between negative 5 and negative 15 degrees in some embodiments of the present disclosure. FIG. 4 further depicts this angle 430 between the proximal side 422 of the side band 412 and the line perpendicular with the bottom edge 424 of the side band 412. The line and angle are shown in FIG. 4 for illustration purposes and are not meant to be additional physical portions of the device 400.

Figure 4A:
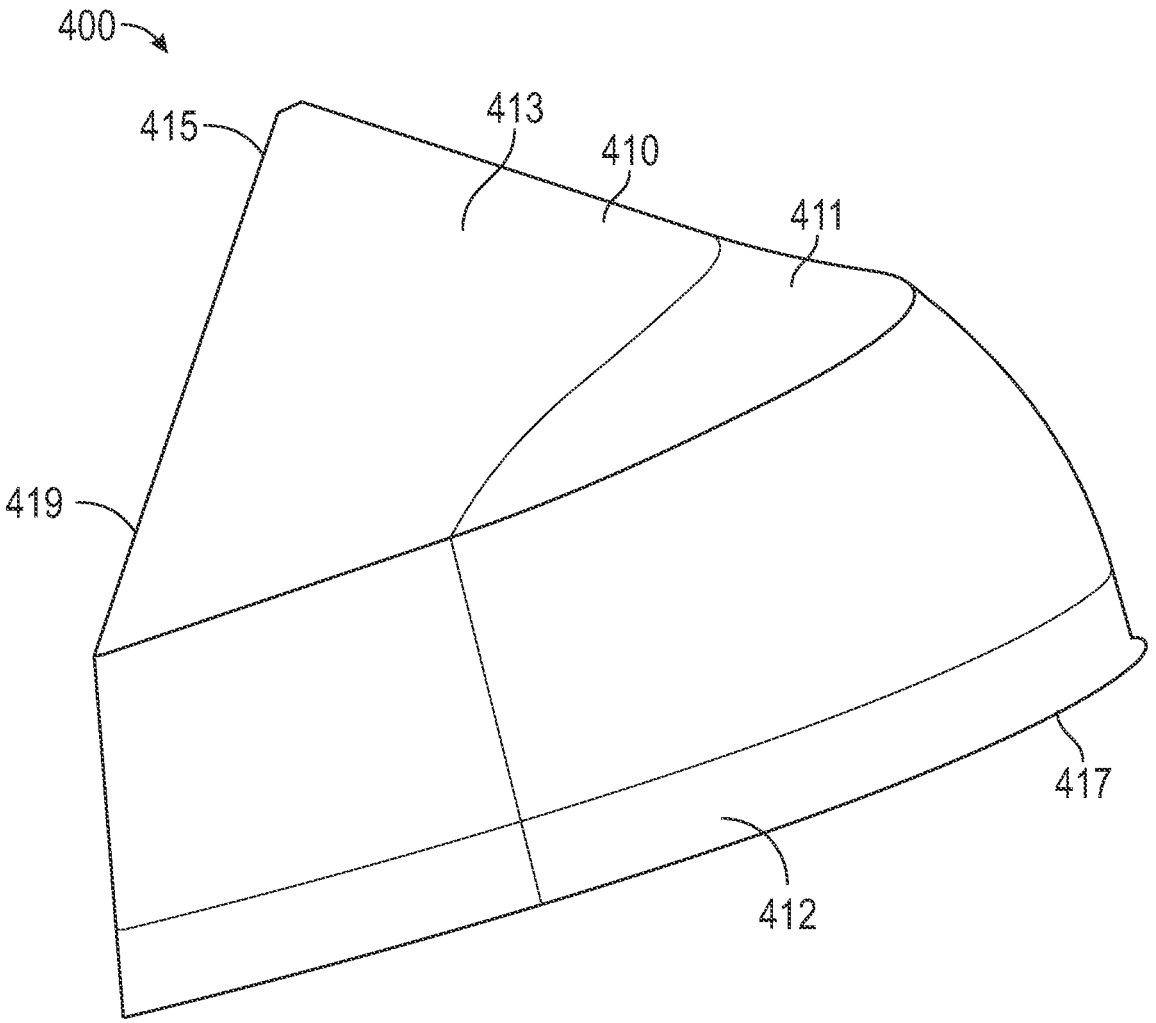
FIG. 4*a* depicts a system for limiting transfer of thermal energy in ski boots according to embodiments described herein.

As shown in FIG. 4*a*, in some embodiments, the upper shell 410 may further comprise a first shell 411 and a second shell 413. The first shell 411 may be integrally connected to the distal edge 417 of side band 412 and to the second shell 413. The second shell 413 may be integrally connected to the first shell 411 and to a proximal upper length 419 of the side band 412 and may comprise a proximal upper edge 415 of the device 400. In some embodiments, the first shell 411 may connect to the side band 412 at a lower angle than an angle at which the first shell 411 connects to the second shell 413 such that the first shell 411 is configured to be flatter than the second shell 413 when the device is attached to the ski boot. Such configurations may allow the device 400*a* to be better configured to conform to the shape of ski boot for some embodiments.

Returning to FIG. 4, in some embodiments, the thickness 440 of the device may be between about 0.1 millimeters and about 10 millimeters thick. In some embodiments, a central thickness 442 at the integral connection between the upper shell 410 and the side band 412 may be wider than an outer thickness 444 at the proximal end of the upper shell 410 of the device 400. In some embodiments, the ratio of the central thickness 442 to the outer thickness 444 may be from about 2:1 to about 5:2. In some embodiments said ratio may be as much as 20 to 1. In some embodiments, an outer lip 446 may extend beyond the upper shell 410 at the upper shell's 410 proximal side and is not included in the ratios given above.

In some embodiments, the bottom outer edge 424*a* of the side band 412 may be at a thickness equal to or less than the central thickness 442. The thickness of the device 400 may gradually change from one thickness to the next, creating a smooth transition between thicknesses. In some embodiments, the thickness of the device 400 may change more abruptly. The device 400 may be generally configured to roughly conform to the shape of the ski boot it is configured to cover. In some embodiments, the device 400 may be configured to closely conform to the shape of the toe box portion of the ski boot it is configured to cover.

In some embodiments, the device 400 may be thickest where the upper shell 410 meets the side band 412 of the device 400 and may thin in the direction of the proximal edge of the upper shell 410 that, when positioned on ski boot, is closest to the vamp of the ski boot—see arrow 448 in FIG. 4, which shows this direction for clarity. In some embodiments, this thickest point may be between 1.5 and 5.5 millimeters thick. In some embodiments, it may be preferred to have a thickest width of about 2 millimeters thick. Different embodiments may have different preferred thickest widths, including wider than 5.5 millimeters, depending on the thermal limiting needs of those specific embodiments. The differences in thickness throughout the device may be beneficial to both limit heat transfer better in more exposed areas and to allow the device to not interfere with other systems on the ski boot. This includes allowing the ski boot with the device attached to fit properly onto skis, snow boards, or other attachable equipment for ski boots.

Figure 5:
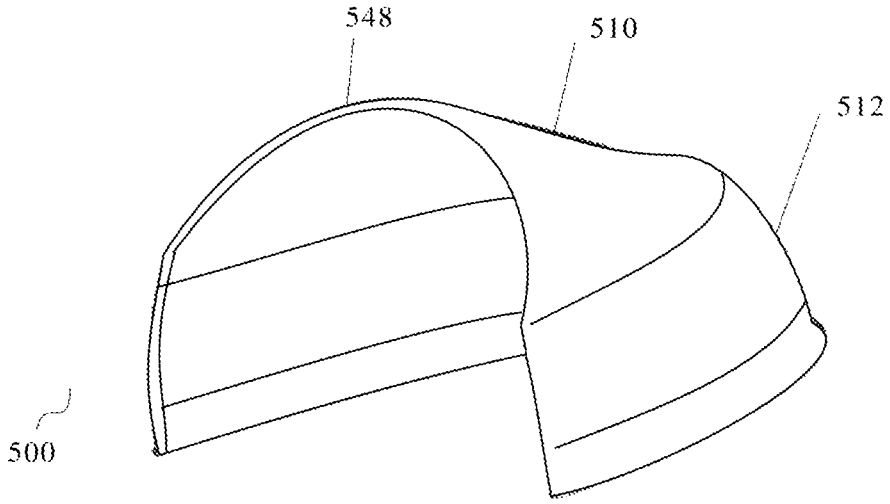
FIG. 5 depicts a system for limiting transfer of thermal energy in ski boots according to embodiments described herein.
Figure 5A:
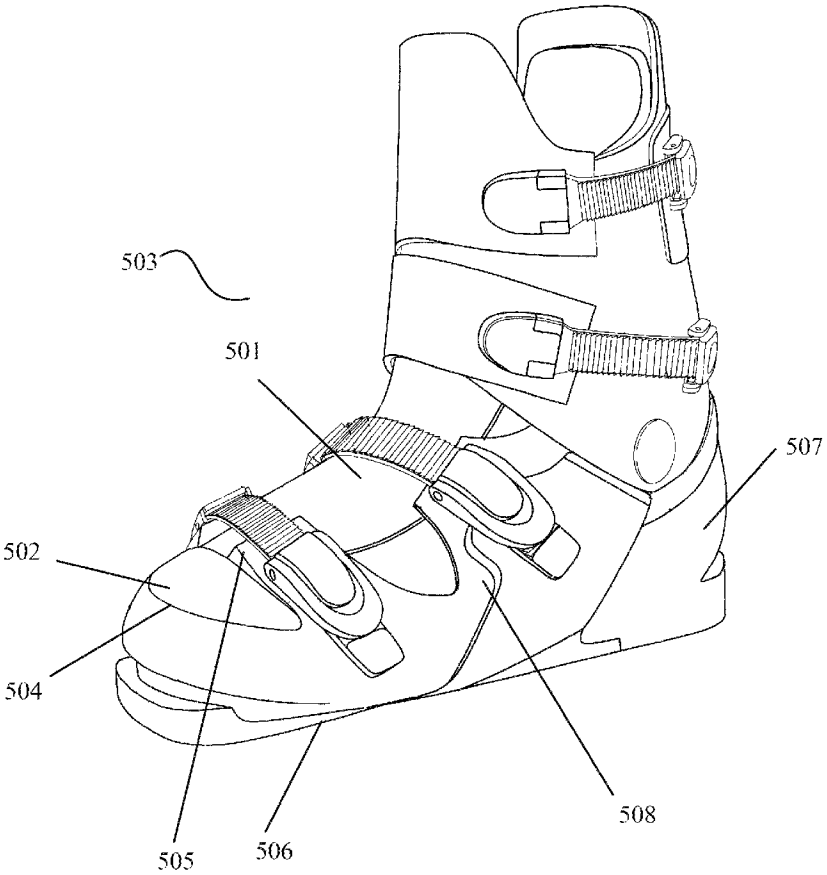
FIG. 5*a* depicts a ski boot which receives benefit from the embodiments described herein.

Turning to FIG. 5, an embodiment of the present disclosure comprises a cover 500 for limiting transfer of thermal energy of a ski boot (not explicitly depicted in FIG. 5). One type of ski boot which greatly benefits from the features of the present disclosure is exemplified in FIG. 5*a*. The ski boot of FIG. 5*a* has a shell 503 comprising a toe box portion 502, a toe end 504, a sole 506, an upper 501, a heel 507, a vamp portion 508 and a throat portion 505, the cover 500 consisting essentially of an upper shell 510, a side band 512, and an attachment structure 548. The upper shell 510 may be configured to cover a top section of the toe box portion 502 of the shell 503 of the ski boot. The top section of the toe box portion 502 comprising an area spanning lengthwise from the lower edge of the upper vamp portion 508 of the ski boot to the upper edge of the toe end 504 of the ski boot and spanning width-wise across the width of the ski boot. The side band 512 may be integrally connected to the upper shell 510 and may be configured to cover a majority of a set of side sections of the toe box portion 502 of the shell 503 of the ski boot. Said set of side sections may extend from the top of the side of the toe box 502 to the sole 506. The set of side sections may further extend from the center of the toe end 504 along both sides of the toe box 502. The upper shell 510 and the side band 512 of the toe cover 500 cover a majority of the toe box portion 502 of the shell 503 of the ski boot.

The attachment structure 548 may be configured to connectively attach the cover 500 to the ski boot. In some embodiments, the attachment structure 548 may be further configured to connectively attach the upper shell 510 of the ski boot cover 500 to the top section of the toe box portion of the shell of the ski boot. the attachment structure 548 may comprise a hook and loop tape, glue, double stick tape or other securing structure. In some embodiments, the attachment structure 548 may comprise more than one securing structure. In some embodiments, attachment structure 548 may preferably be comprised of an adhesive. The adhesive may be any means capable of adhering the cover 500 to the ski boot including double coated lamination polyester tape with acrylic adhesive. Examples of such tape include those produced by 3M® Company designated Foam Lamination Tapes L1, L2, and L3 types. Such tapes may further remain adhesive at low temperatures, including to negative 40 degrees Fahrenheit. The adhesive structure 548 may be applied as a strip as shown in FIG. 5, may be applied as a structure that covers a larger area of the underside of the cover 500, or may be comprised of several tape strips in some embodiments, as will be appreciated by those skilled in the art using the present disclosure.

In some embodiments, an alternative attachment structure (similar to attachment means 320 in FIG. 3) may connect the upper shell 510 of the toe cover 500 to the top section of the toe box portion of the shell of the ski boot by means of an elastic band attached to a bottom edge of the side band 512 in at least two places such that the elastic band is configured to stretch underneath the sole of the ski boot. The attachment structure may additionally or alternatively be configured to connectively attach the upper shell 510 of the ski boot cover 500 to the top section of the toe box portion of the shell of the ski boot. The side band 512's proximal edge may end at an angle between about 5 and about 15 degrees from a line perpendicular with a bottom edge of the side band 512 of the toe cover 500 where the bottom edge of the side band 512 is parallel with the base of the ski boot.

The cover 500 may be comprised of a material that limits the transfer of thermal energy. In some embodiments, the cover 500 may be further coated with a water resistant or water proof coating. Such coating may be useful to aid in the durability and strength of the cover 500. In some embodiments, the coating may be comprised of rubber or a rubber substitute or other equivalent protective layer suitable to adhere to thermal resistant materials.

In some embodiments the cover 500 may be composed of one or more layers of foam or foam-like materials. These foam or foam-like materials may have either the same or different densities. These foam or foam-like materials may be formed into layers, which being bonded together, provide enhanced insulating properties to the toe cover while also being durable. Use of foam or foam like materials are also easy to work with in the manufacturing process.

In some embodiments, the toe cover may be formed of a plurality of layers of material which are secured or bonded to one another. Thermoforming compression may be utilized to form the toe cover. In one particular embodiment an inner shell layer is formed of a non-compressed foam having a hardness of 20-25 and a thickness of 4 mm. The inner shell layer is secured to an outer shell layer. The outer shell layer may be formed of two layers, each layer being fabricated from the same type of foam, e.g. a non-compressed, 105 hardness foam. In this construction, one of the two layers of the outer shell layer may be 4 mm in thickness while the other layer may have a thickness of 6 mm. Thermoforming compression may be utilized to form a toe cover construction having a thickness which may vary between 1 mm to 6 mm. While thermoforming can provide very desirable results in securing the various layers together, this process does have some limitations. For example the maximum degree that foam can be successfully compressed by thermoforming without damaging the foam or producing dimensional instability, e.g. warping and misshaping, in the final product is about 50%. Therefore, a single layer of 6 mm foam won't compress to 1 mm successfully. However, with two layers of the same foam type, the desired results can be achieved.

In a preferred embodiment of the toe cap the main toe portion of the toe cap is formed of a layer of 4 mm non-compressed, 105 hardness foam. After thermoforming compression this layer defines a thickness of between 1 mm to 2 mm. The toe top bump layer of the toe cap, defined as that centrally positioned top portion of the toe cap has a greater thickness to provide a more effective thermal barrier. In a preferred embodiment, this toe top bump layer may be formed of 6 mm non-compressed, 105 hardness foam, which after thermoforming compression defines a layer having a thickness of 3-6 mm.

In some further embodiments, the outer shell may be fabricated from a more rigid or harder material such as rubber, rubber-like materials, synthetic plastic polymers such as PVC (polyvinyl chloride) or materials which exhibit hardness levels which are even higher than those of rubber, rubber-like materials, or synthetic plastic polymers such as PVC.

In some embodiments, the toe cover 500 may have a thermal resistance R value between about 1 and 14, in some embodiments the thermal resistance R value may be between 3 and about 7. In some embodiments, the toe cover 500 may be between about 0.1 and about 10 millimeters thick.

As shown in FIG. 6, some embodiments of the device, generally designated at 600, may include a strip 605. The strip 605 may be attached to a middle upper edge of the upper shell 603 of the device 600. The strip 605 may be configured to extend onto the vamp portion of the ski boot to cover an overlap area of the ski boot and may further be configured to be placed under at least one securing device on the ski boot. Securing devices on the ski boot may include shoe laces, buckles, hook and loop tape, or other equivalent mechanisms for securing ski boot onto a foot, including securing devices as depicted in referenced patents above incorporated by reference. The strip 605 may be configured to sit in between the outside of the ski boot and the securing device or devices of the ski boot on the upper vamp portion of the ski boot. Thus, if the ski boot had laces, the strip 605 would be able to be inserted onto the throat of the ski boot, underneath the laces, while remaining on the outside portion of the ski boot. For a ski boot with buckles, the strip 605 may be configured to be placed underneath buckles designed to keep a foot inside the ski boot, while still being on top of the shell of the ski boot. The strip 605 may be configured to fit between the overlap of a front entry ski boot under the lower at least one buckle. In some embodiments, the strip 605 may be configured to fit under at least two buckles.

In some embodiments, the strip 605 may be configured to be waterproof or water resistant. The strip 605 may provide a gusset to prevent leakage into the ski boot. Such therefore further solves a common problem of snow melting and leaking into ski boots when the ski boots close in the front as strip 605 may be configured to cover the overlap of front closures on the ski boot thus preventing moisture from entering the ski boot via said overlap. The strip 605 may serve as a means for attachment of the device 600. The strip 605 may further be configured to keep the device 600 from coming off the ski boot when in use. The strip 605 and the strap 620 may be used together in some embodiments to form the attachment device for the device 600 such that the device 600 may be configured to connectively attach the device to the ski boot. The strip 605 may be comprised of a waterproof or water resistant material or may have waterproof or water resistant properties. In some embodiments, the strip 605 may be made of rubber or an equivalent material.

In some embodiments, the strip 605 may be used as attachment means with strap 607 and with adhesive as described above as an embodiment of attachment structure 548. In some embodiments, it may be preferred to use strip 605 and adhesive to secure the device 600 to the ski boot. In some embodiments it may be even more preferred to use only adhesive, as described in embodiments of attachment structure 548 as the attachment device for device 600. Such adhesive may preferably be a double coated lamination polyester tape with acrylic adhesive including such as manufactured by 3M® brand foam lamination tape type L1.

Equivalent tapes and glues may be used as adhesive for some embodiments as will be understood by those having skilled in the art using the teachings of the present disclosure.

The device 600 may further comprise a symbol 652. The symbol 652 may be a letter, word, art, line drawing, or other picture depiction. Multiple words, letters, lines, or other artistic rendering may be used as symbol 652. Symbol 652 may be debossed or embossed on the upper shell 610. In some embodiments, symbol 652 may be located on other parts of the device 600.

Figure 7A:
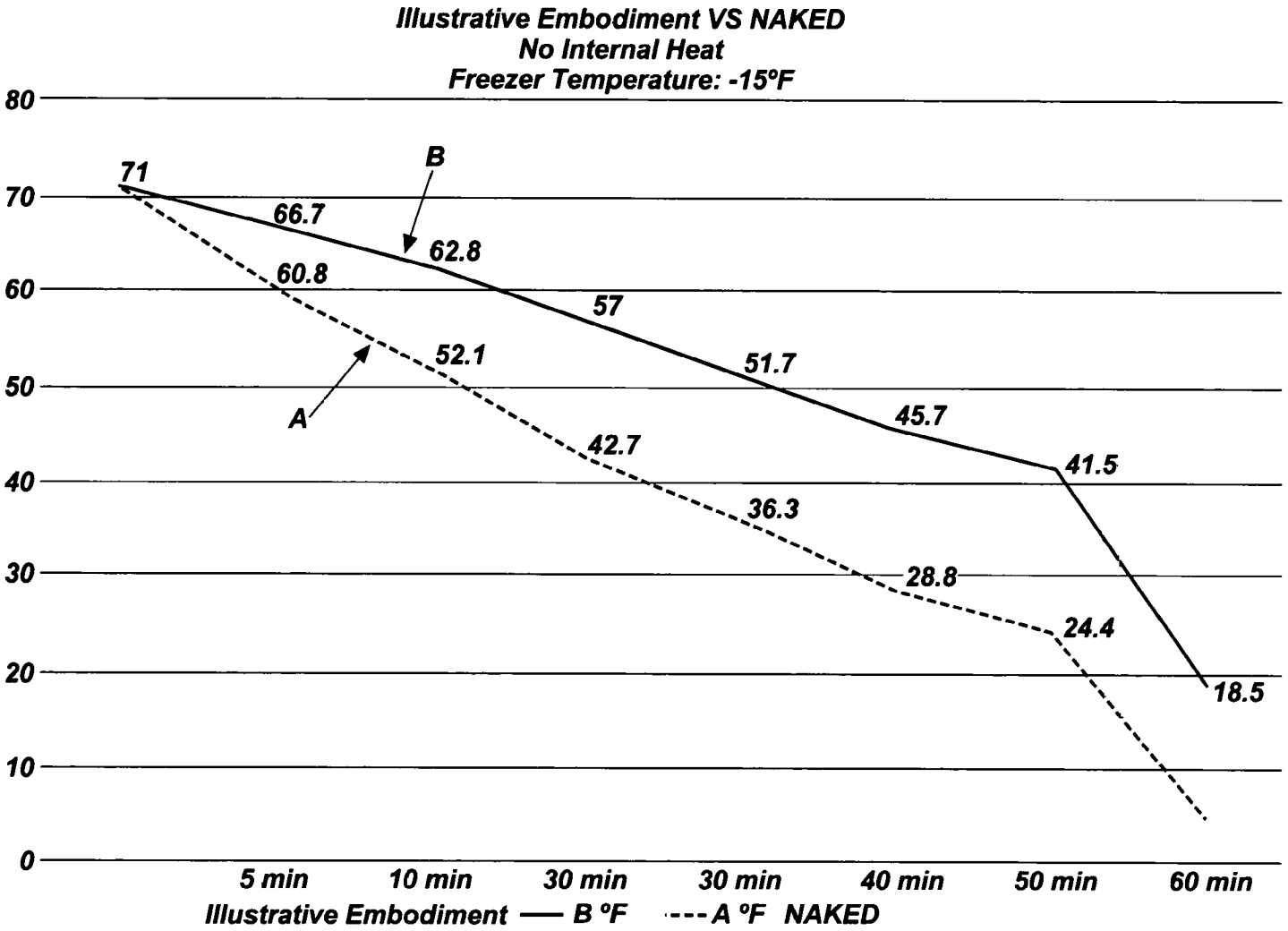
FIGS. 7*a*-7*c* depict data showing the beneficial reduction in thermal transfer conducted in tests 1, 2 and 3 of one of the embodiments described herein.
Figure 7B:
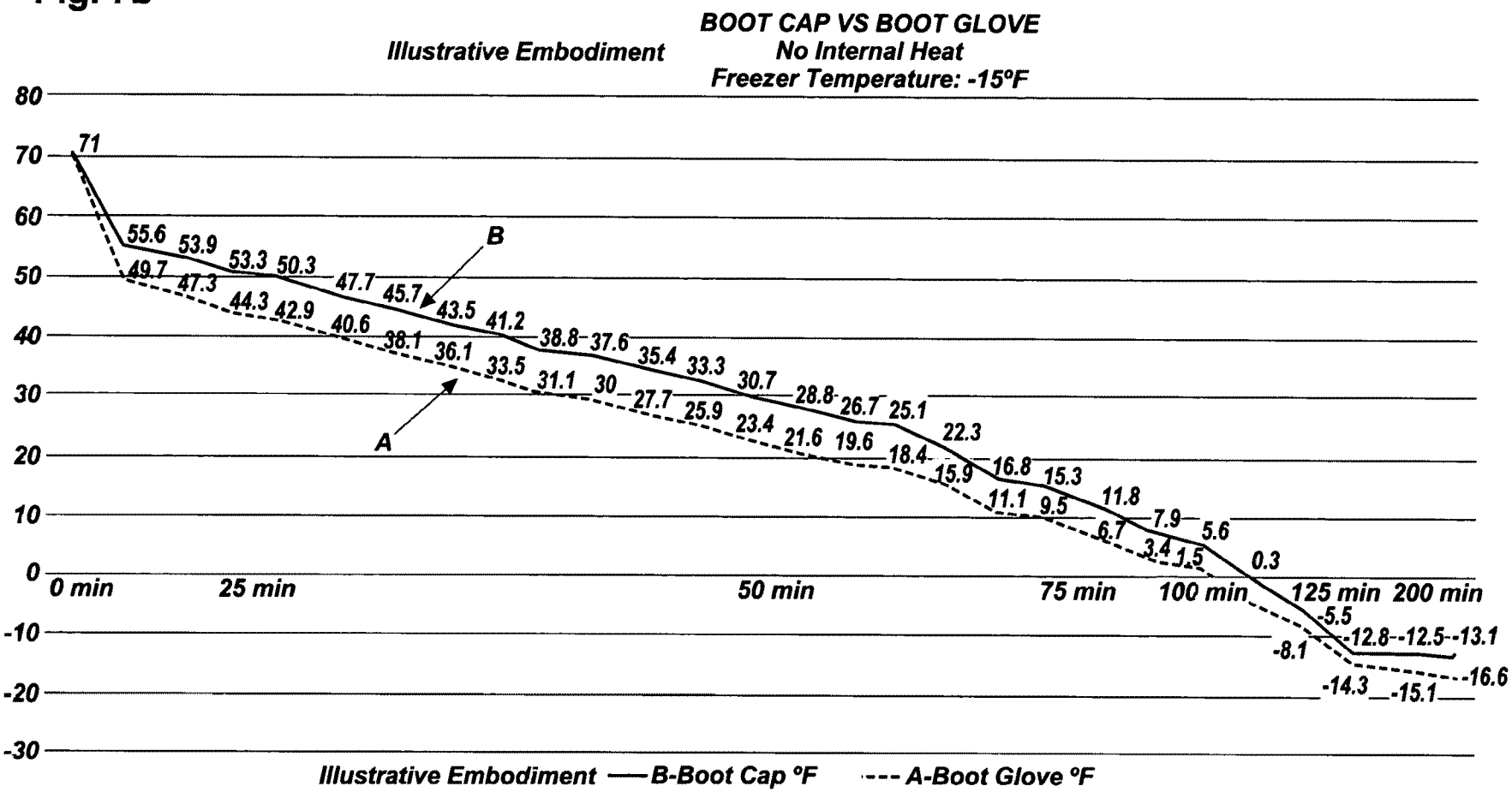
Figure 7C:
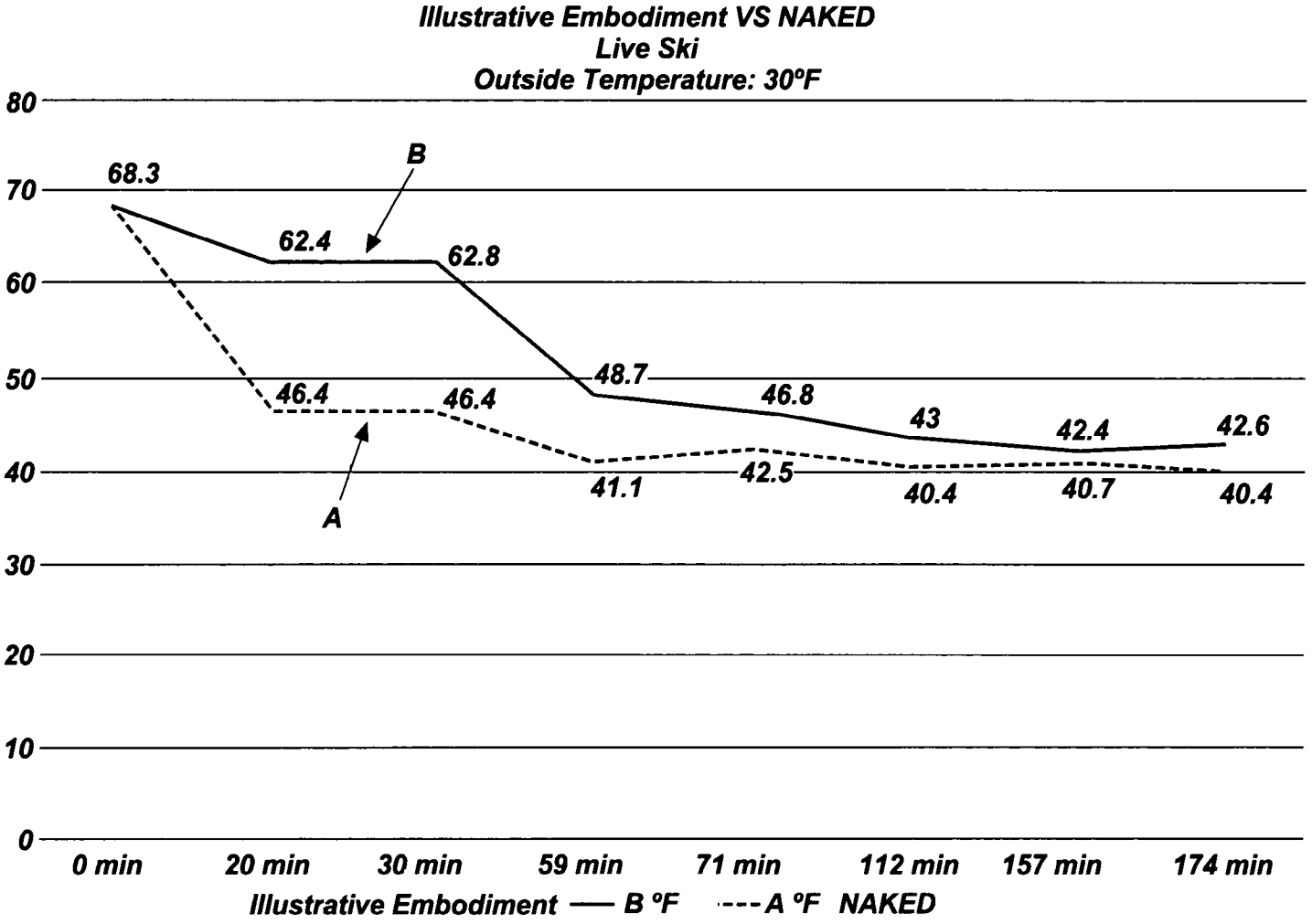

FIGS. 7*a-c* depict results from testing showing the unexpected results and beneficial features of embodiments of the present disclosure. Such results are not limiting to the embodiments described herein.

Three tests were performed. In Test 1, represented in FIG. 7*a*, a temperature reading device was attached to the inside liner of the toe box portion of each of two ski boots. These two ski boots were then placed in a 71 degree temperature space to begin testing and then placed in a negative 15 degree space for one hour. For the entirety of Test 1, one of the ski boots was fitted with a device as embodied herein, the other was left without a device. Both ski boots had a towel placed inside to simulate a calf muscle in each ski boot. Temperature data was collected every five minutes for an hour. Test 1 is intended to see how the device performs on ski boots as compared to ski boots without a device in cold temperatures.

In Test 2, a temperature reading device was again attached to the inside liner of the toe box portion of each of two ski boots. The two ski boots were again placed in a 71 degree temperature space to begin testing and then placed in a negative 15 degree space for three hours. For the entirety of test 2, one ski boot was fitted with a device as embodied herein and the other ski boot was fitted with a boot glove device as known to those in the art. Both ski boots had a towel placed inside to simulate a calf muscle in each ski boot. The temperature was measured every two minutes for three hours. Test 1 is intended to see how the device performs on ski boots as compared to ski boots with a boot glove device, as known in the art, in cold temperatures.

In Test 3, a temperature reading device was attached to the inside liner of the toe box portion of each of two ski boots. These two ski boots were then placed in a 68 degree temperature space to begin testing and then placed outside for three hours where the temperature was 30 degrees and the wind chill factor was 14 degrees. For the entirety of Test 3, one of the ski boots was fitted with a device as embodied herein, the other was left without a device. The ski boots were placed on a person's feet for this third, field test. Test 3 was similar to Test 1, but placed the device in real-world conditions to see how it performed with a real human in outside temperatures.

As shown in FIG. 7*a*, the results of Test 1 were unexpected to those skilled in the art. The ski boot with the system in accordance with the present disclosure, represented by curve B in the graph, was unexpectedly warmer with an average temperature gradient of fifteen degrees as compared to the ski boot without the device, represented by curve A in the graph.

As shown in FIG. 7*b*, the results of Test 2 were unexpected by those skilled in the art as well. The ski boot with the device as embodied herein attached, represented by curve B in the graph, was unexpectedly warmer than the ski boot with a boot glove device, represented by curve A in the graph, with an average temperature gradient of 7 degrees. At the end of the test, the temperatures did lower to a smaller gradient, but the ski boot with the device as embodied herein was still warmer than the ski boot with the boot glove device.

As shown in FIG. 7*c*, the results of Test 3 were also unexpected by those skilled in the art. The ski boot with the device as embodied herein attached, represented by curve B in the graph, was unexpectedly warmer than the ski boot with a boot glove device, represented by curve A in the graph, with an average temperature gradient of 8 degrees for the three hour test, with the highest temperature gradient reading 17 degrees. At the end of the test, the temperature gradient was still over 2 degrees.

All three tests used an embodiment of the device similar to that depicted in FIG. 5, comprising an upper shell, a side band, and an attachment device and was comprised of a foam material.

All temperature readings for all three tests showed a higher temperature for the ski boot with a device as embodied herein attached thereto for the entirety of all three tests. These tests illustrate the unexpected results from a device covering such a small portion of ski boots and as compared to devices known in the art. Furthermore, it is the body extremities, namely the toes of a person's foot, that are key to comfort in extreme temperatures, such as those experienced while snow skiing. Thus, the testing shows that the device has beneficial properties to limit the transfer of thermal energy for ski boots and slow conduction through the shell of the ski boot, in a manner that was unexpected and better than devices known to those in the art.

Figure 8:
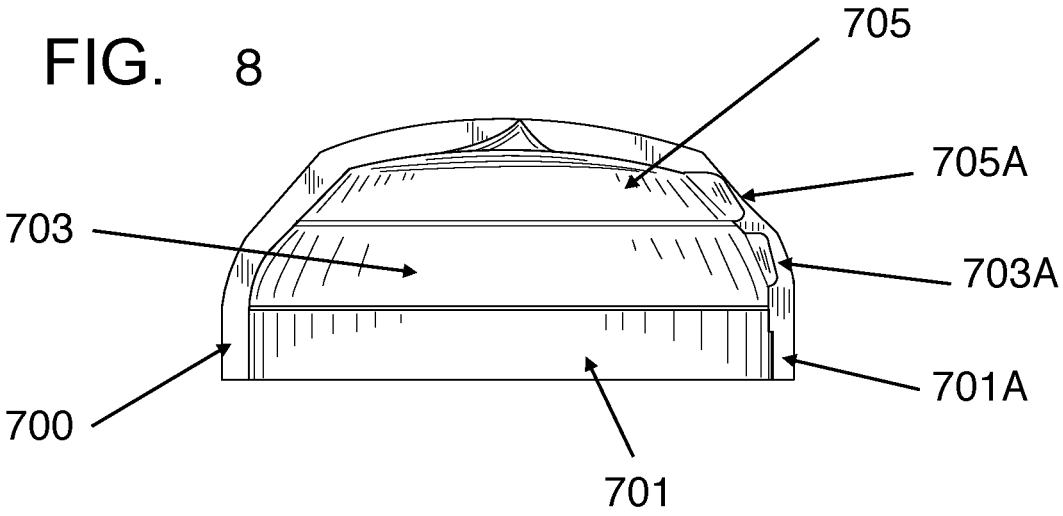
FIGS. 8-8*a* depict an embodiment of a device for limiting the transfer of thermal energy of ski wherein an attachment structure for attaching the device to the ski boots includes an adhesive secured to the underside of the device and a plurality of strip covers detachably mounted over the adhesive.
Figure 8A:
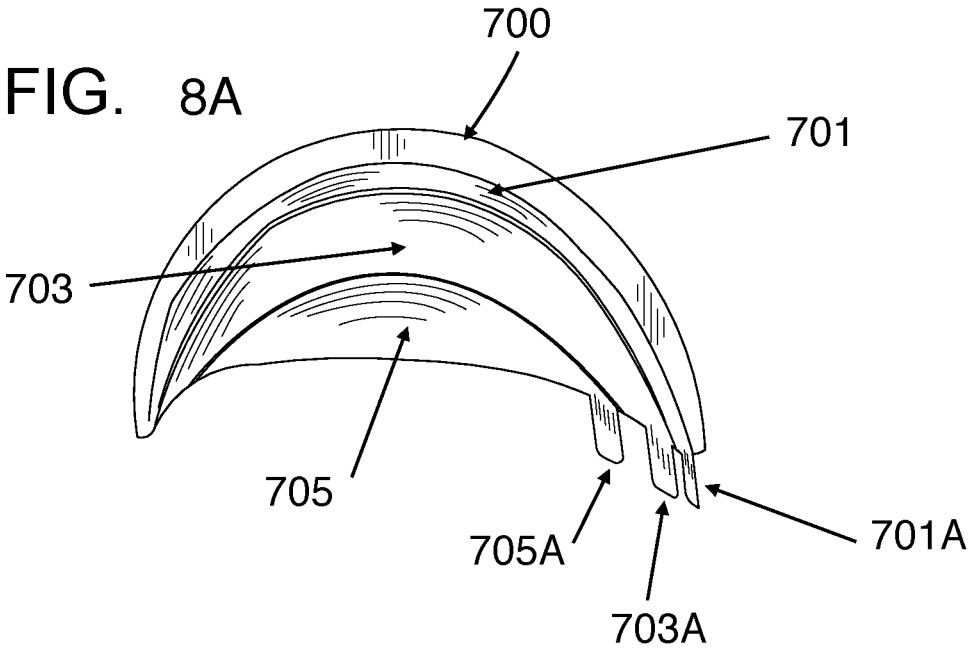

With reference to FIGS. 8 and 8A, the device may include an attachment structure in which the underside of the device 700 includes an adhesive such as two sided tape of the type previously described or alternatively another form of adhesive. Positioned over the adhesive is one or more covers 701, 703 and 705. As shown, in one embodiment these covers may be positioned contiguous to one another to form a cover over the adhesive resident on the underside of the device 700. The covers may be fabricated from a material which forms a very low strength adhesive securement or bond with the underlying adhesive, e.g. a wax paper type of material. These covers are individually configured to be detachably removed from the adhesive to thereby expose the adhesive which lies under each respective cover.

As shown, the covers 701, 703, and 705 may extend laterally from one side of the underside of the device 700 to the other side of that device. Each cover defines a tab 701A, 703A and 705A on its end. The tab provides a means whereby the user may readily grab each tab and pull the cover from its positioning over the adhesive and thereby remove the respective cover from the device 700. The covers 701, 703 and 705 may be removed from the device 700 selectively to expose desired areas of the underside of the device. Depending on the particular shape of the ski boot being fitted with the device 700, the user can selectively remove the covers to sequentially expose desired areas of adhesive and thereby facilitate the securement of the device without the complications which would otherwise be encountered if all of the adhesive resident on the underside of the device were exposed at the same time. Accordingly, the user may selectively remove the covers in an sequence which permits the device to be applied to the ski boot smoothly, while avoiding unwanted wrinkles in the device.

Figure 9:
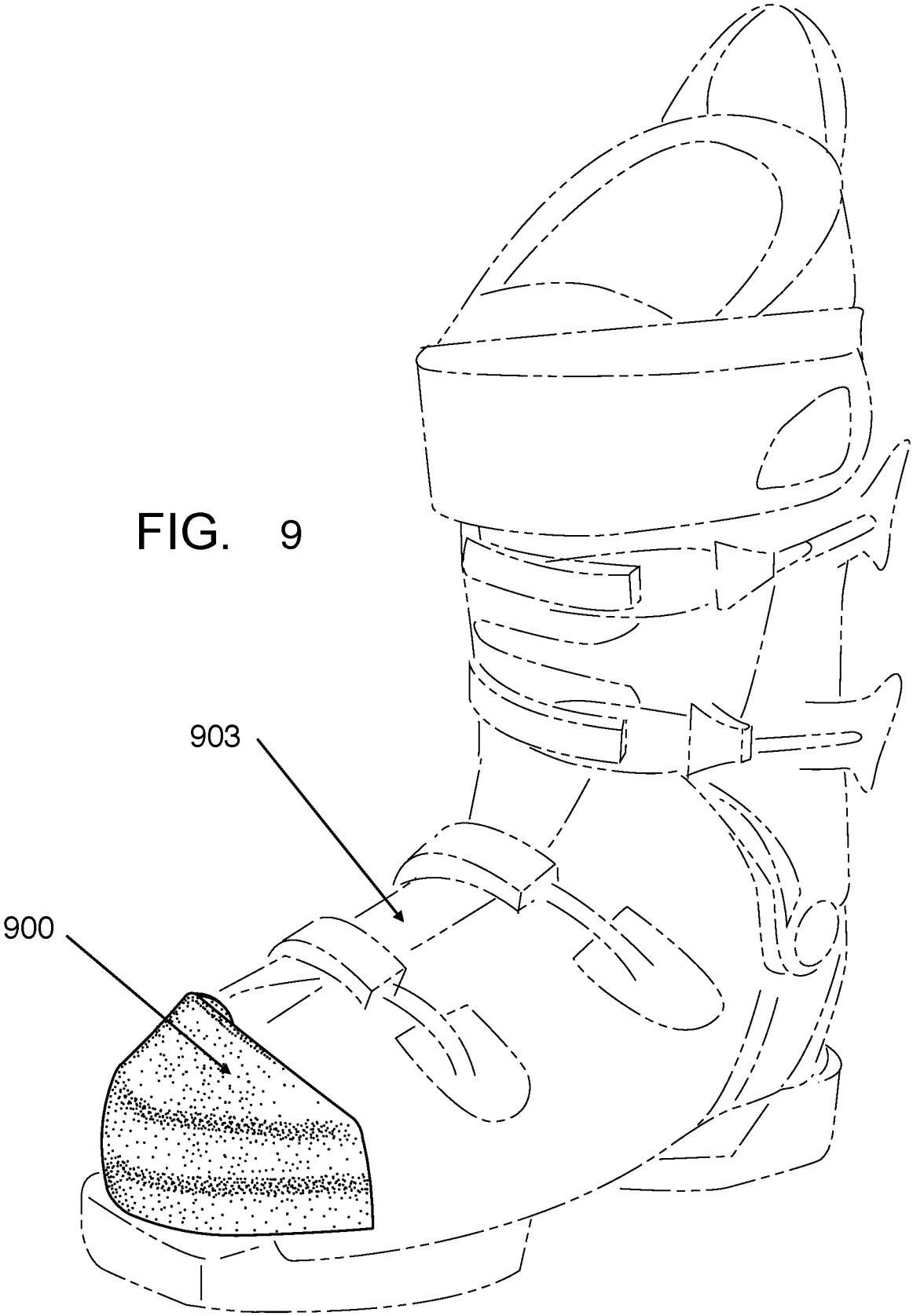
FIG. 9 depicts a device for limiting the transfer of thermal energy of ski boots mounted on a ski boot, wherein the ski boot is shown in broken lines (phantom lines) for clarity purposes.
Figure 10:
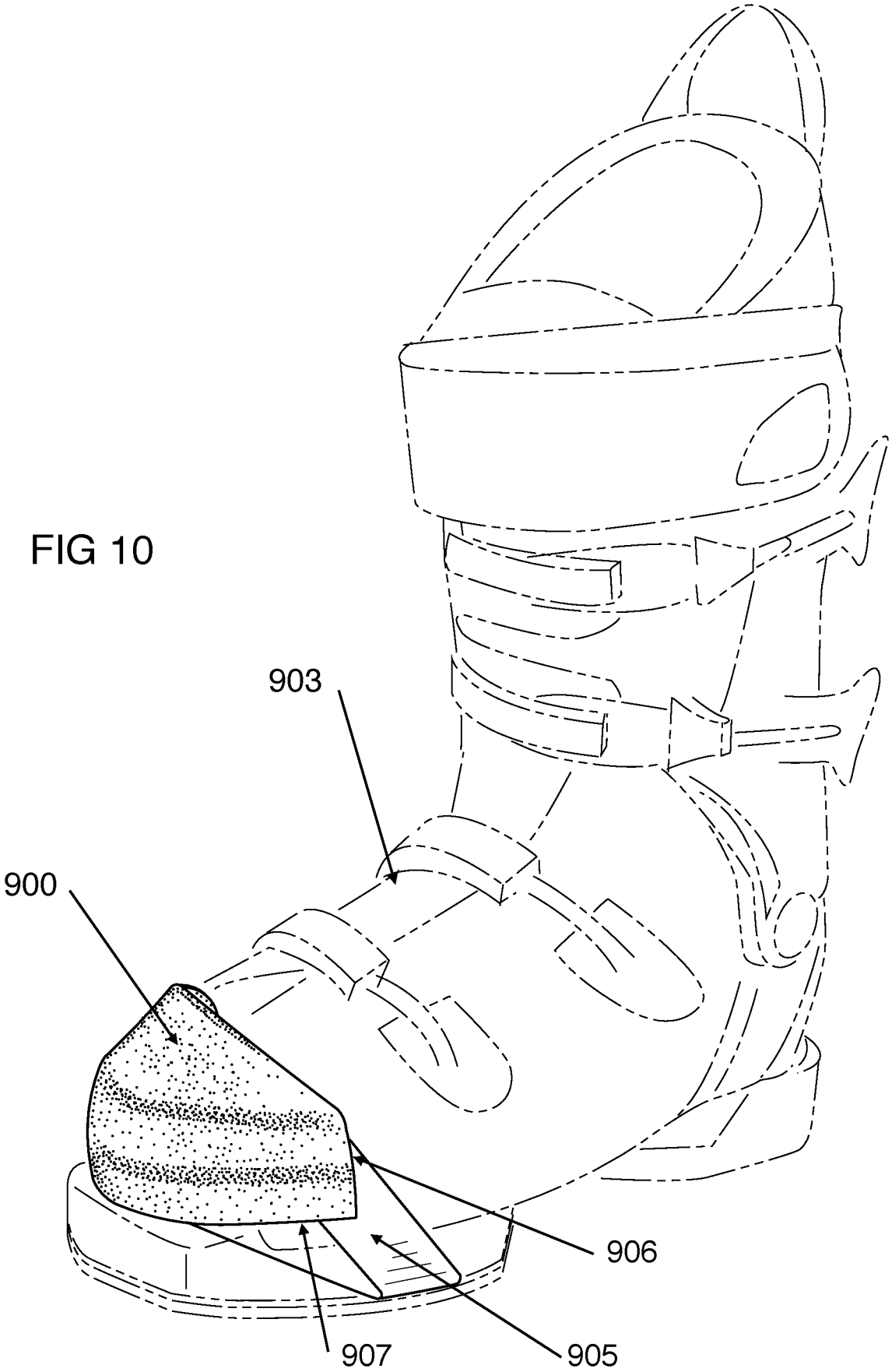
FIG. 10 depicts a device for limiting the transfer of thermal energy in ski boots having an attachment structure which includes a strap member, the ski boot being shown in broken lines for clarity purposes.

FIGS. 9 and 10 depict the device 900 installed on a ski boot 903, which is shown in phantom for clarity purposes. FIG. 10 shows an embodiment of the attachment device which was previously described in FIG. 6. In the embodiment shown in FIG. 6, the attachment strap is shown extending generally orthogonally from the bottom edge of the device. In contrast in this particular embodiment, the strap 905 is shown attached to the body of the device 900 such that its longitudinal axis is oriented at an angle 906 to the bottom edge of the device 900 which is not 90 degrees. The invention contemplates orienting the strap 905, at various angles the angle between the longitudinal axis of the strap 905 and the bottom edge of the device 900.

This disclosure may also include a method of using a device for limiting the transfer of thermal energy of ski boots and slowing the conduction through the shell of the ski boot, thus keeping the toes and feet warmer for a longer period of time. The method may further include using said device as a buffer to the outside elements, particularly the cold. In some embodiments, the steps of the method using the device may include providing a device for limiting the transfer of thermal energy of ski boots, the device comprising an upper shell configured to cover a top section of the toe box portion of the ski boot, a side band integrally connected to the upper shell and further configured to cover a majority of a set of side sections of the toe box portion of the ski boot and attaching the device to the ski boot. The method may further include the steps of affixing an attachment structure that is configured to connectively attach the device to the ski boot.

The present disclosure may also include a method of making a device for limiting the transfer of thermal energy of ski boot. In some embodiments, the steps of the method for making the device may include forming an upper shell of the device, forming a side band to be integrally connected to the upper shell, and connecting an attachment device configured to connectively attach the device to the ski boot to the device. In some embodiments, the steps of the method may further comprise connecting a strip to a middle upper edge of the upper shell of the device. The step of connecting an attachment device may further comprise attaching an attachment adhesive to the underside of the upper shell. In some embodiments, the step of connecting an attachment structure may further comprise attaching a strap on each side of a bottom edge of the side band of the device, forming a loop that is configured to be placed underneath the sole of the ski boot.

In some embodiments, the device 800 may be configured and shaped to conform to the curve of the toe box portion 802 of a shell 803 of a ski boot, such that it forms a similar curvature to the curvature of the toe box portion 802 of the ski boot, and further may be configured to cover the majority of the toe box portion 802 of the ski boot, as shown in FIG. 8*a*. In some embodiments, the device may comprise a proximal upper edge, that may be curved concavely, in a similar shape to the curve formed on the toe end of the ski boot the device is configured to attach to.

In some embodiments, the device may further be colored to coordinate with the color scheme of the ski boot.

In the foregoing Detailed Description, various features of the present disclosure are grouped together in a single embodiment for the purpose of streamlining the disclosure. This method of disclosure is not to be interpreted as reflecting an intention that the claimed disclosure requires more features than are expressly recited in each claim. Rather, as the following claims reflect, inventive aspects lie in less than all features of any single foregoing disclosed embodiment. Thus, the following claims are hereby incorporated into this Detailed Description by this reference, with each claim standing on its own as a separate embodiment of the present disclosure.

It is to be understood that the above-described arrangements are only illustrative of the application of the principles of the present disclosure. Numerous modifications and alternative arrangements may be devised by those skilled in the art without departing from the spirit and scope of the present disclosure and the appended claims are intended to cover such modifications and arrangements. Thus, while the present disclosure has been shown in the drawings and described above with particularity and detail, it will be apparent to those of ordinary skill in the art that numerous modifications, including, but not limited to, variations in quantities, proportions, materials, and manner of making and use may be made without departing from the principles and concepts set forth herein.

The invention claimed is:

1. A device for limiting transfer of thermal energy of a ski boot, the ski boot having a toe box portion, a toe end, a sole, and a vamp portion, the device comprising:

an upper shell configured to cover a top section of the toe box portion of the ski boot;

a side band integrally connected to the upper shell, the side band further configured to cover a majority of a set of side sections of the toe box portion of the ski boot; and a strip attached to a middle upper edge of the upper shell of the device, the strip configured to extend onto the vamp portion of the ski boot and to cover an overlap area of the ski boot, the strip further configured to be placed under at least one securing buckle on the ski boot, wherein the device is thickest and includes a first thickness at a junction where the upper shell meets the side band, and wherein the device tapers in thickness in a longitudinal direction along the upper shell from a toe end to a terminal top edge of the upper shell, from the first thickness to a second thickness that is thinner than the first thickness, the second thickness disposed toward the terminal top edge of the upper shell that is closest to a vamp portion of the ski boot when the device is positioned on the ski boot, and wherein the device is comprised of a foam material that limits the transfer of thermal energy therethrough such that the device is configured to limit the transfer of thermal energy from an inside of the toe box portion of the ski boot to outside air by providing an insulative buffer in cold conditions.

2. The device of claim 1, further comprising an attachment device configured to connectively attach the device to the ski boot.

3. The device of claim 1, wherein the device is comprised of a closed cell ethylene-vinyl acetate (EVA) foam.

4. The device of claim 1, further comprising a strap attached to each side of a bottom edge of the side band, the strap configured to slide under the sole of the ski boot.

5. The device of claim 2, wherein the attachment device is configured to be adhered to an underside of the device and a top section of the toe box portion.

6. The device of claim 1, wherein the strip is comprised of a water resistant material and is configured to protect the overlap area of the ski boot by resisting water penetration from outside of the ski boot to inside of the ski boot.

7. The device of claim 1, wherein the upper shell comprises a first shell and a second shell, and wherein the first shell is connected to the second shell.

8. The device of claim 1 wherein:

said top section of the toe box portion comprises an area that covers a majority of a top section of the toe box portion of the ski boot spanning lengthwise from a lower edge of the vamp portion of the ski boot to an upper edge of the toe end of the ski boot and across the upper shell of a width of the toe box portion of the ski boot;

said set of side sections extends from a top of the side of the toe box to the sole and extending from a center of the toe end along both sides of the toe box such that the upper shell and the side band of the device cover a majority of the toe box portion of the ski boot; and an attachment device is configured to connectively attach the device to the ski boot, wherein the device is comprised mostly of a material that limits the transfer of thermal energy.

9. The device of claim 8, wherein the device is comprised of closed cell foam.

10. The device of claim 8, wherein the attachment device is configured to adhere an underside of the upper shell to an outer section of the toe box portion of the ski boot.

11. The device of claim 8, wherein the attachment device comprises double coated lamination polyester tape with acrylic adhesive.

12. The device of claim 8, wherein the attachment device further comprises a strip attached to a front under side of the upper shell of the device that is configured to secure to the device by being configured to be placed under at least one buckle of the ski boot.

13. The device of claim 1, consisting essentially of:

said upper shell;

said side band; and an attachment device.

14. The device of claim 13, wherein the attachment device includes an elastic band.

15. A method of making a device for limiting the transfer of thermal energy through a ski boot, the method comprising the steps of:

forming an upper shell of the device, the upper shell comprising a foam material;

forming a side band integrally connected to the upper shell, the side band comprising the foam material; and attaching a strip to a middle upper edge of the upper shell, the strip configured to extend onto a vamp portion of the ski boot and to cover an overlap area of the ski boot, the strip further configured to be placed under at least one securing buckle on the ski boot, wherein the upper shell is configured to cover a top section of a toe box portion of the ski boot, wherein the side band is configured to cover a majority of a set of side sections of the toe box portion of the ski boot, and wherein the device is configured to limit the transfer of thermal energy from an inside of the toe box portion of the ski boot to outside air by providing an insulative buffer in cold conditions.

16. The device of claim 7, wherein the first shell appears flatter on the ski boot than the second shell.

* * * * *